US006987134B1

(12) United States Patent
Gagnon

(10) Patent No.: US 6,987,134 B1
(45) Date of Patent: Jan. 17, 2006

(54) HOW TO CONVERT CARBON DIOXIDE INTO SYNTHETIC HYDROCARBON THROUGH A PROCESS OF CATALYTIC HYDROGENATION CALLED CO2HYDROCARBONATION

(76) Inventor: Robert Gagnon, 2875 Descoteaux Street, Sherbrooke, Quebec (CA) J1K 1N7

( * ) Notice: Subject to any disclaimer, the term of this patent is extended or adjusted under 35 U.S.C. 154(b) by 20 days.

(21) Appl. No.: 10/881,136

(22) Filed: Jul. 1, 2004

(51) Int. Cl.
*C07C 27/00* (2006.01)
*C07C 1/00* (2006.01)

(52) U.S. Cl. ..... 518/700; 585/733; 518/715

(58) Field of Classification Search ..... 518/700, 518/715; 585/733, 638
See application file for complete search history.

(56) References Cited

U.S. PATENT DOCUMENTS 3,842,113 A * 10/1974 Ichikawa et al. ..... 518/714
5,952,540 A * 9/1999 Lee et al. ..... 585/733

* cited by examiner

*Primary Examiner*—J. Parsa

(57) ABSTRACT

This process uses two catalysts instead of one, converting CO2 into C8H18. Addition of a NaCl catalyst to a Ni catalyst improves the efficiency of Fischer's process because the salt catalyst retains humidity. Furthermore, chlorine opens chemical chains and sodium prevents crystals of oxygen from covering the Ni catalyst. If we are equipped to produce CO2 from biogas or smoke, we can recycle this CO2 and yield a useful liquid. In fact, recycling CO2 into a synthetic crude hydrocarbon, octane, contributes to clean air and to produce a valuable source of energy. Because CO2 is a renewable resource, this process favors a lasting economic development.

2 Claims, No Drawings

HOW TO CONVERT CARBON DIOXIDE INTO SYNTHETIC HYDROCARBON THROUGH A PROCESS OF CATALYTIC HYDROGENATION CALLED CO2HYDROCARBONATION

FIELD OF THE INVENTION

The present invention is directed to a process for producing hydrocarbons from carbon dioxide, in particular, to a process for producing synthetic crude hydrocarbon from carbon dioxide by catalytic hydrogenation.

BACKGROUND OF THE INVENTION

Converting carbon dioxide into synthetic hydrocarbon through catalytic hydrogenation is a process invented by M. Fischer and M. Tropsch during the twenties and thirties. As M. Bergius at the same time, they used an iron catalyst to produce hydrocarbons. In 1925, Fischer-Tropsch produced a real industrial synthesis of hydrocarbons and oils under normal pressure with a cobalt catalyst and thorine. These processes were improved in 1930 and during world war 2 using nickel and nickel-cobalt catalysts. The Fischer-Tropsch process was also applied in England by the Synthetic Oil Cy Ltd using cobalt and thorium catalysts. Other companies improved the Fischer-Tropsch process using costly alloy catalysts without succeeding to eliminate problems of instability due to the presence of oxygen, humidity or water vapor in the reactor. See canadian patent no. 2,410,760 and U.S. Pat. No. 3,979,332.

SUMMARY

There are many processes converting carbon dioxide into liquid synthetic hydrocarbon. Everybody knows that catalytic hydrogenation is feasible but its efficiency is problematic mostly because of the instability due to the unavoidable presence of oxygen and water vapor in the reactor. We also know that catalysts act as accelerators or as decelerators in chemical reactions without being part of the finished products. In converting carbon dioxide into liquid synthetic hydrocarbon through catalytic hydrogenation, the use of a nickel catalyst or other similar catalysts necessitates many manipulations which may affect expected output. This invention brings in a second catalyst, salt, which retains humidity. Furthermore, chlorine opens chemical chains and sodium prevents crystals of oxygen from covering the nickel catalyst. Doing so, the salt catalyst improves the action of the nickel catalyst. Catalytic hydrogenation of carbon dioxide becomes more regular and easier to standardize. This catalytic hydrogenation of carbon dioxide regularly produces 72% water and 28% octane.

DETAILED DESCRIPTION

Many sources of carbon dioxide has been experienced: for example, biogas, smoke, etc. are fundamental sources of CO2 and raw materials for future processing through catalytic hydrogenation. Another possibility could be burning organic matters in order to produce the greatest quantity of carbon dioxide.

Catalysts used in this process are a nickel catalyst, Ni, and a salt catalyst, NaCl. These two catalysts must be powdery or crushed to a size a diameter less than 1 mm. For the required quantity of these catalysts, we must know the capacity of the reactor. In general, we use about 2 parts of salt for 1 part of nickel in other words about 6%–10% wt. of salt and about 3%–5% wt. of nickel. Because catalysts are not part of the finished products, it is not necessary to have definite quantities of each catalyst but it is important to have more salt than nickel, 2 times more is a good approximation. These proportions come from the specific action of each catalyst: the nickel catalyst makes possible the synthesis of carbon and hydrogen when the salt catalyst retains humidity. Furthermore, chloride opens chemical chains and sodium prevents crystals of oxygen from covering the nickel catalyst. These catalysts must be mixed before putting them in a reactor.

We put the nickel-salt catalyst into a reactor covering the largest area inside this reactor. Into the reactor, we blow 2 gases, carbon dioxide and hydrogen, according to proportions already defined in the formula: 8CO2+25H2=C8H18+16H2O in other words about 87% carbon dioxide+13% hydrogen for an appropriate result of about 28% octane and about 72% water. We heat up to a constant inside temperature of about 250° C.–350° C. While heating at constant temperature, we maintain inside gases at constant pressure of about 2500 p.s.i.–3500 p.s.i. as long as the conversion is progressing, in other words during less than about 30 minutes. The whole process of conversion works more effectively if the reactor is shaked because actions of catalysts are improved. When chemical reactions are finished, we extract the octane-water mixture and we filter it to separate octane from water.

The embodiments of the invention in which an exclusive property or privilege is claimed are defined as follows:

1. A process for producing octane by the reaction of hydrogen gas with carbon dioxide in the presence of a catalyst being made up of about ⅓ of crushed nickel, Ni, and about ⅔ of crushed salt, NaCl, caracterised by the circulation of hydrogen gas and carbon dioxide in the presence of this nickel-salt catalyst at a constant temperature of about 250° C.–350° C., at a constant pressure of about 2500 p.s.i.–3500 p.s.i. during about 30 minutes.

2. A process as defined in claim 1, in which the said salt catalyst to be used is precipitated on the said nickel catalyst in watery suspension.

* * * * *